United States Patent [19]

Iskendarian

[11] 4,208,072

[45] Jun. 17, 1980

[54] STACKABLE STOOL

[76] Inventor: Alex O. Iskendarian, 1839 N. Winona St., Los Angeles, Calif. 90027

[21] Appl. No.: 943,640

[22] Filed: Sep. 19, 1978

[51] Int. Cl.[2] ..... A47C 7/00

[52] U.S. Cl. ..... 297/440; 108/91; 108/150; 297/239

[58] Field of Search ..... 108/150, 153, 159, 91; 297/239, 440, 462

[56] References Cited

U.S. PATENT DOCUMENTS

| | | | |
|---|---|---|---|
| 2,560,659 | 7/1951 | Payeur | 108/150 X |
| 3,230,909 | 1/1966 | Watson | 108/150 |
| 3,230,910 | 1/1966 | Olsson | 108/150 X |
| 3,850,117 | 11/1974 | Martinelli | 108/150 |

FOREIGN PATENT DOCUMENTS

| | | | |
|---|---|---|---|
| 409599 | 6/1969 | Australia | 108/150 |

*Primary Examiner*—James C. Mitchell
*Attorney, Agent, or Firm*—Julius Louis Rubinstein

[57] ABSTRACT

A support for stools or tables is formed from two identical hollow plastic sections. The sections are generally conical in shape so that they can fit inside each other for stacking purposes when not in use. The smaller end of each section is provided with interlocking means so that the sections may be releasably secured together to form a stool or support for a table.

7 Claims, 13 Drawing Figures

FIG. 1
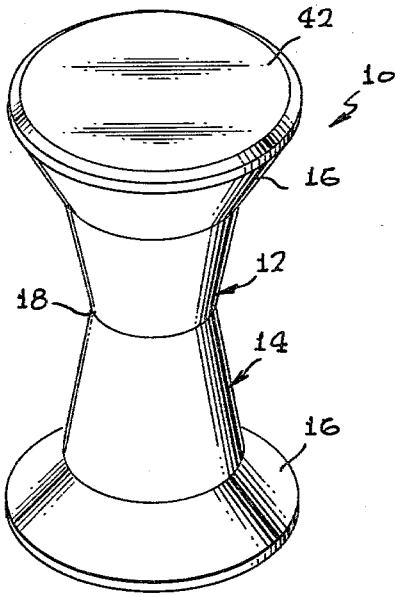
FIG. 2
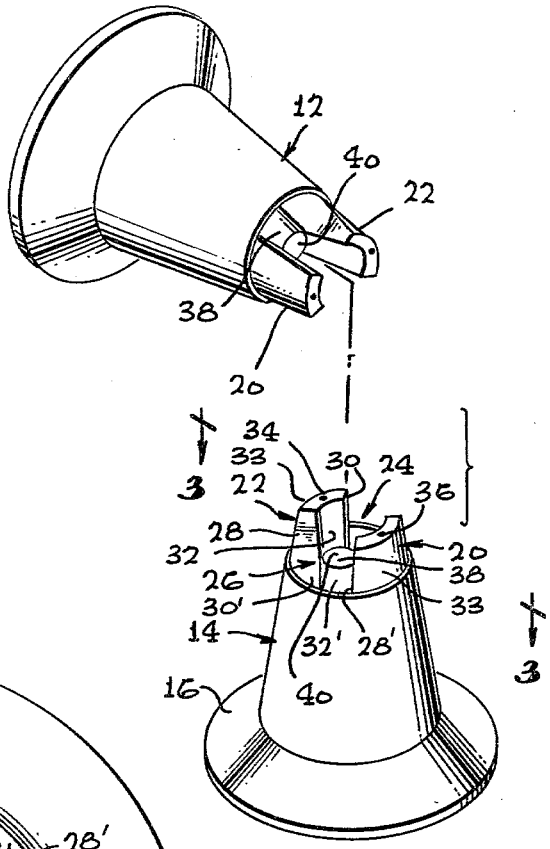
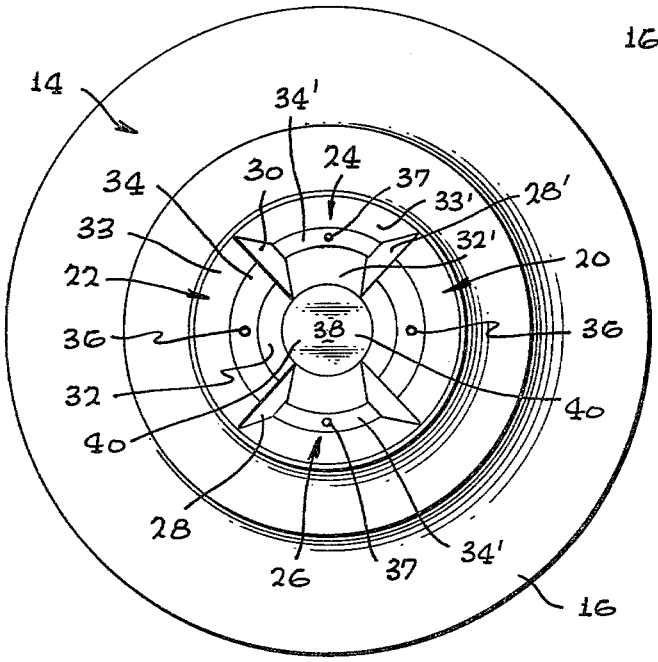
FIG. 3

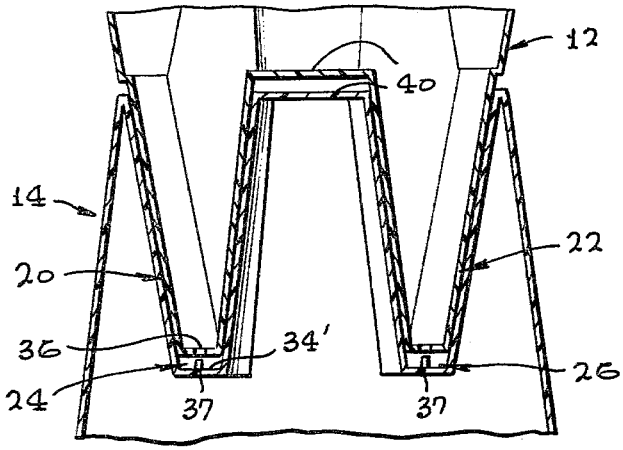
FIG. 5
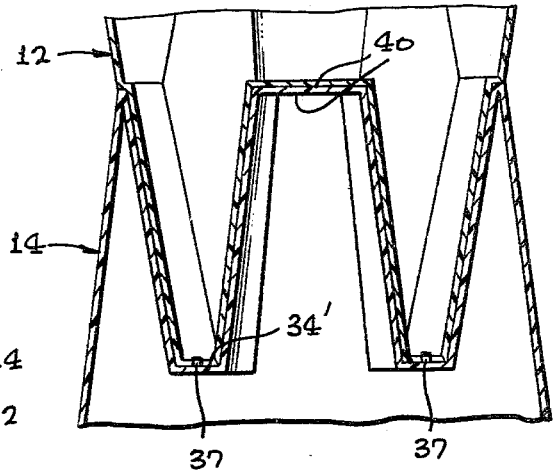
FIG. 6
FIG. 11
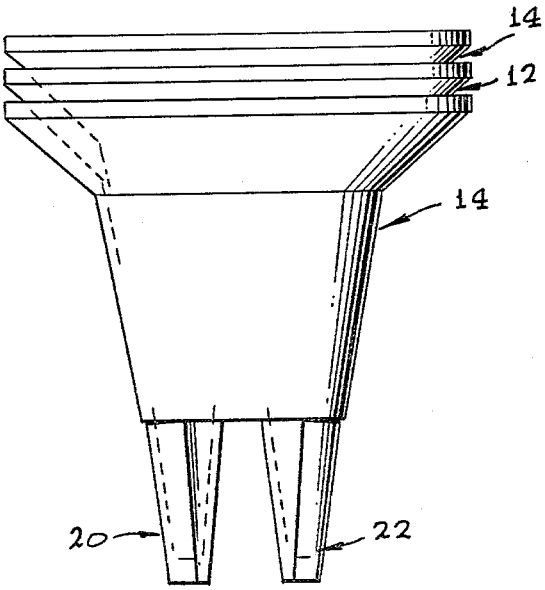

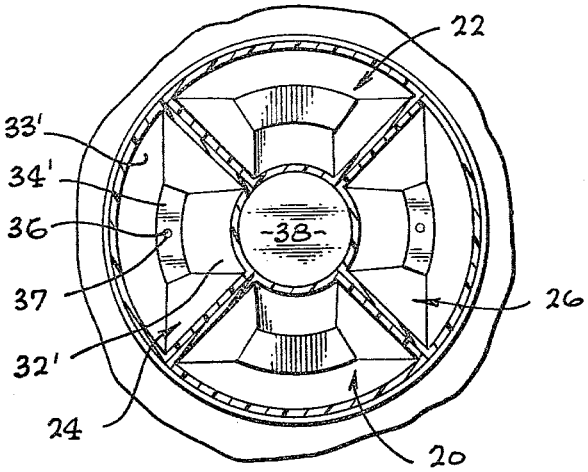
FIG. 7
FIG. 8
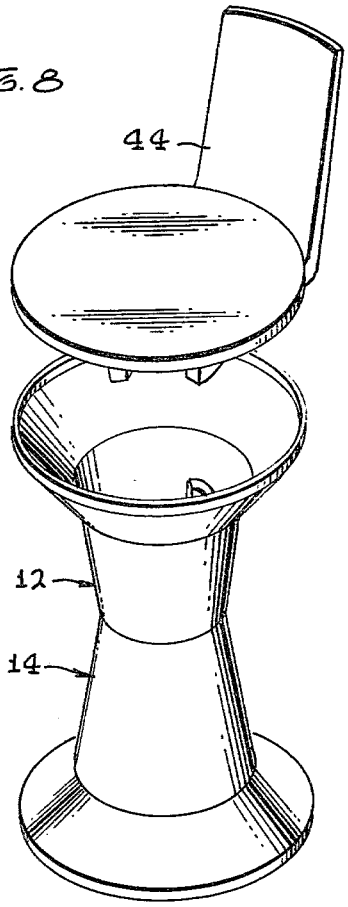
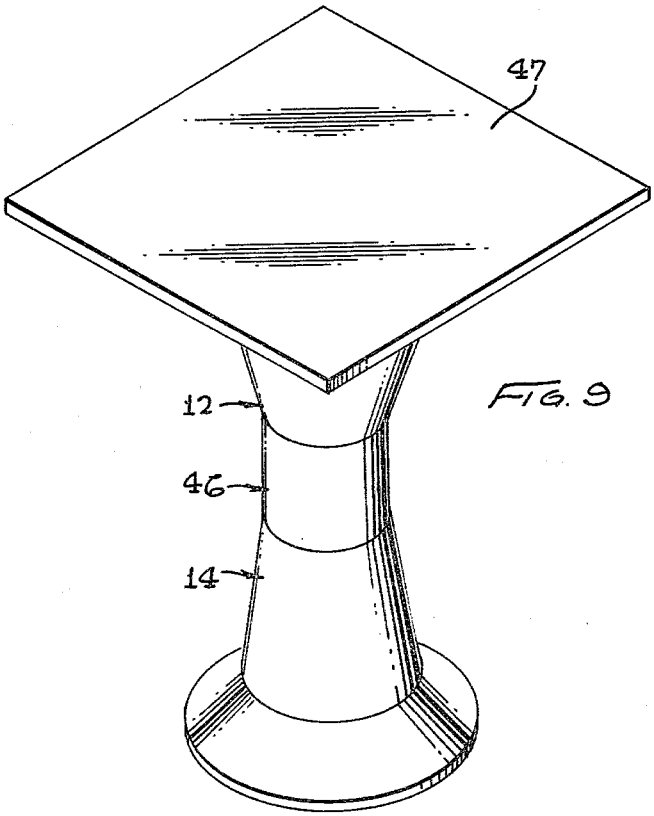
FIG. 9
FIG. 10
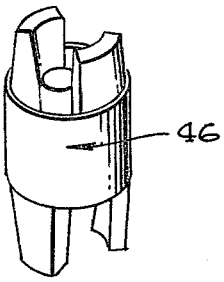

STACKABLE STOOL

BACKGROUND AND BRIEF SUMMARY

Heretofore, many efforts have been made to form stools or supports for furniture from thin plastic sheet material using two generally conical sections in such a way that the stool or support sections can be stacked in a compact manner when not in use. Such prior effects are exemplified by the patents to Martinelli, U.S. Pat. No. 3,850,117; Watson, U.S. Pat. No. 3,230,909; and Olsson, U.S. Pat. No. 3,230,910. The structure described in these patents was designed to provide a solution for the problem of forming a stool or table support from a thin plastic sheet material which can be easily assembled and disassembled and stacked when not in use. However, none of the solutions to this problem heretofore known, was satisfactory. Some stools required nuts and bolts to assemble the parts together. This, in the case of furniture designed for repeated assembly and disassembly, was objectionable because the fasteners could be lost. In other cases, the interlocking structures of the sections was not sturdy enough to withstand repeated assembly and disassembly and stacking. The reason the interlocking sections were not strong enough was because they were formed from a thin plastic sheet material which became deformed after the sections had been assembled and disassembled a few times. This deformation prevented the sections from being assembled together in any secure way.

The object of this invention is to overcome the disadvantages inherent in prior structures by providing a strong stool or support which can be formed from thin plastic materials and which can be assembled and disassembled without deformation and without the use of tools, and which can be stacked repeatedly without affecting the ability of the sections to hold together in a secure manner.

This and other objects of this invention will become more apparent when better understood in the light of the accompanying drawings and specifications wherein:

FIG. 1 is a perspective view of a stool constructed according to the principles of this invention.

FIG. 2 is an exploded perspective view of the stool shown in FIG. 1.

FIG. 3 is a sectional view taken on the line 3—3 of FIG. 2.

FIG. 5 is a partial sectional view of the stool shown in FIG. 1 showing the relationships of portions of the sections in assembled relation but with no weight on the stool.

FIG. 6 is the same view as FIG. 5 but showing how the controlled deformation of the sections under weight provide added strength to the stool.

FIG. 7 is a sectional view taken on line 7—7 of FIG. 4.

FIG. 8 shows the principles of this invention applied to a bar stool.

FIG. 9 shows the principles of this invention applied to a support for a table.

FIG. 10 is a perspective view showing a spacer used in the construction of a table shown in FIG. 9.

FIG. 11 shows the sections in stacked relationship.

Figure 12:
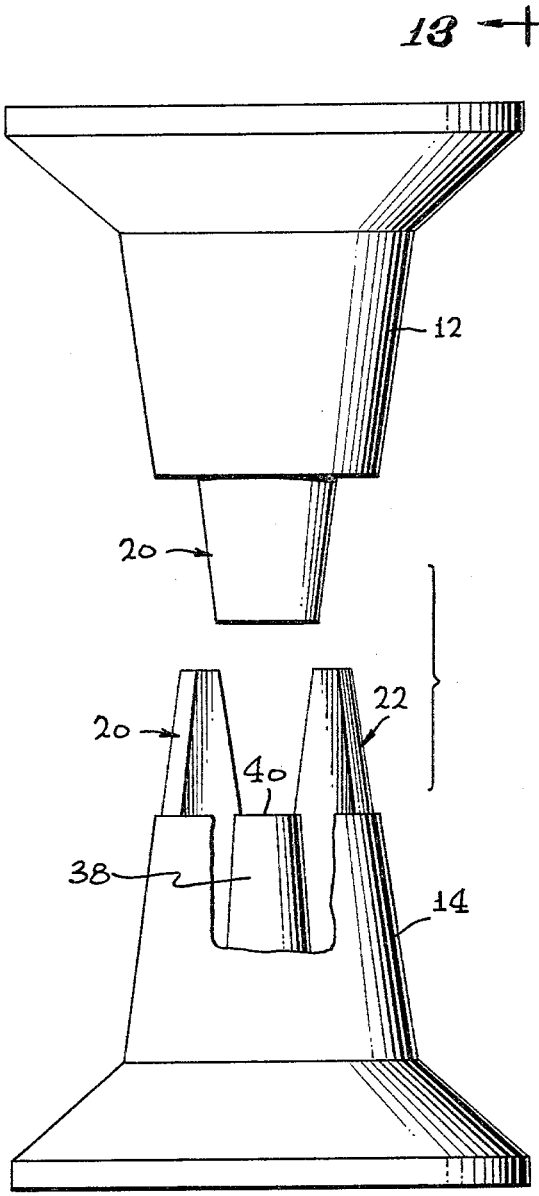
FIG. 12 is an exploded elevational view of the stool with portions of section 14 broken away to reveal the centrally disposed support pedestal.
Figure 13:
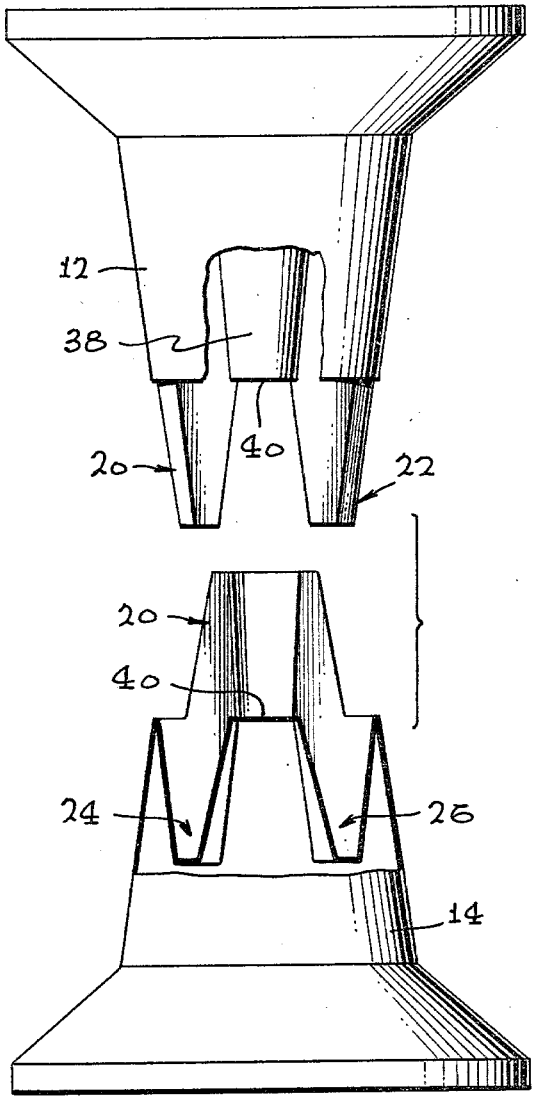

FIG. 13 is an exploded elevational view taken on line 13—13 of FIG. 12, rotating the stool 90°, with parts broken away in section 12 to reveal the upper support pedestal and with projection 22 of section 14 removed to reveal the inner surface of section 20.

Referring now to FIG. 1 of the drawings, a support or pedestal for a stool indicated generally by the reference numeral 10 comprises identical portions 12 and 14 in the form of generally truncated conical sections. Each section has a radially projecting flange 16 at the lower or base end. The upper or small base end 18 of each section is provided with projections 20 and 22 and a complimentary shaped recess 24 and 26, see FIG. 2. As seen, projections 20 and 22 extend above the plane of the small base 18.

Figure 4:
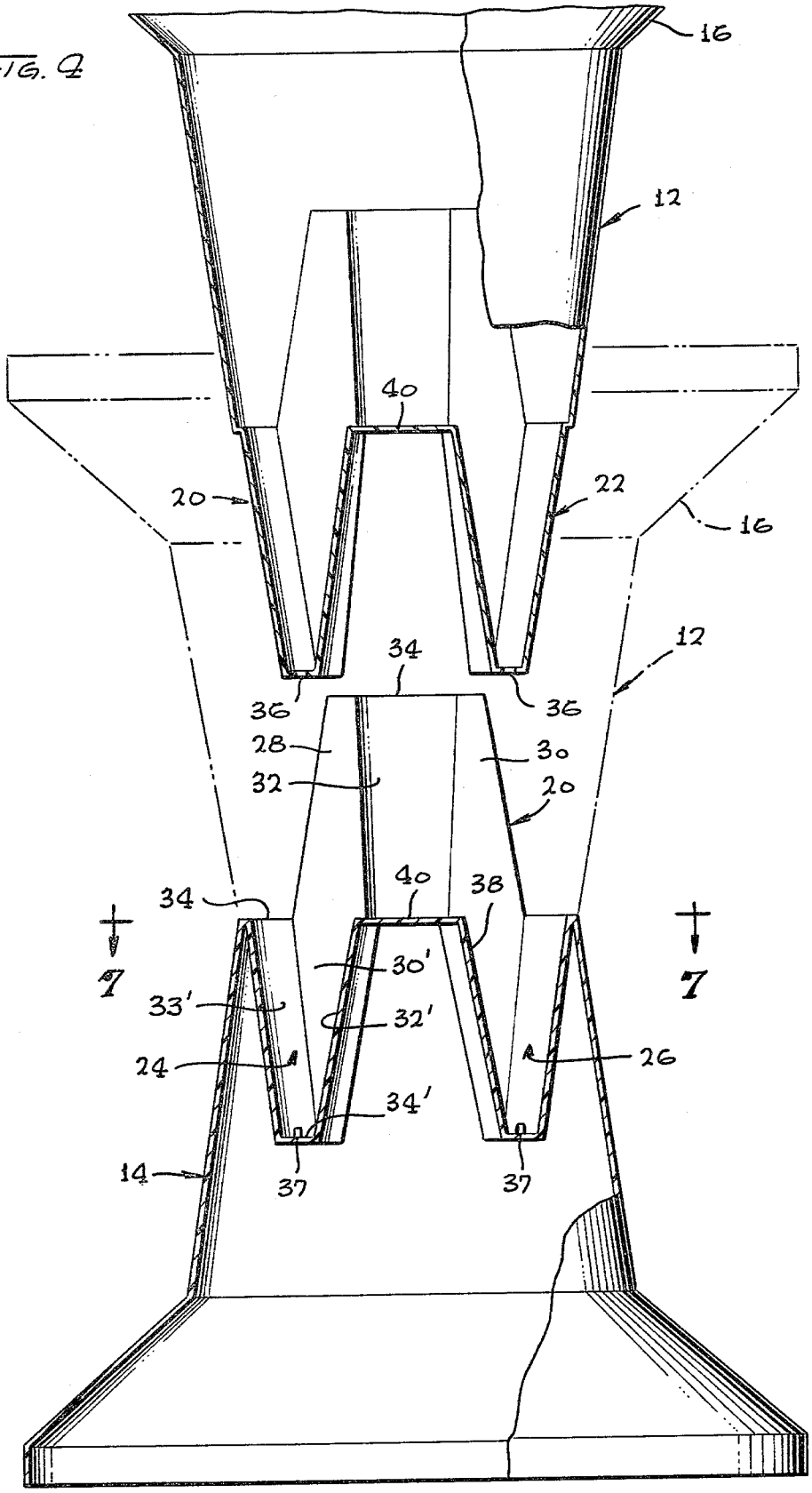
FIG. 4 is a sectional elevational view of the stool shown in FIG. 1.

As seen in FIGS. 2 and 4, the projections 20 and 22 are upwardly tapered and have upwardly tapered walls 28, 30, 32 and 33 and an upper surface 34. The upper surface of each projection is provided with a pin receiving recess 36 which is designed to mate with a pin 37 at the base of a recess in another section. The recesses 24 and 26 are downwardly tapered and are identical in shape with the projections 20 and 22. These recesses are designed to receive projections 20 and 22 from another section, see FIGS. 1 and 2. These recesses, 24 and 26, as seen in FIG. 3, have downwardly projecting walls. Since the projections and recesses are identical in shape and are designed to mate with each other, they are here given identical reference numerals except that the corresponding portions of the recesses are primed to indicate where the corresponding surfaces of a projection abuts against a surface of a recess. Consequently, each recess in Section 14 has a base surface 34′ which, in assembled relationship, is designed to abut or nearly abut the upper surface 34 of a projection from section 12. In addition, the recesses have tapered descending wall portions 33′, 32′, 30′ and 28′ which in assembled relationship abut against corresponding surfaces on the projections of section 12, see FIGS. 1 and 2.

It is noted that the arc length of the identical tapered portions and recesses on each section are ⅓ the circumference of the section as shown in FIGS. 3 and 7 and the projections and recesses are diametrically opposite to each other. This has important consequences because by designing the projections and sections this way, a centrally or coaxially disposed support pedestal 38 in the form of a truncated cone is generated in sections 12 and 14. This support pedestal is tapered and circular in cross-section, see FIGS. 2 and 7. Each pedestal 38 has an upper support surface 40 at or closely adjacent to the plane of the small base of the section.

As seen in FIG. 4, in assembled relationship, the projections 20 and 22 of section 12 fit in the recesses 24 and 26 of section 14. However, as seen in FIG. 5, when there is no weight on the stool or table, the upper surface 40 of the pedestal 38 in each section are adjacent and face each other but do not abut. However, as shown in FIG. 6, when weight is placed on the stool or pedestal, the material of each section deforms slightly and in a controlled way to permit the surfaces 40 to abut each other. Since the support pedestals are concentric with sections 12 and 14, when they do abut, they form a very strong coaxial abutment support inside the assembled stool or pedestal which permit the stool or pedestal to carry a much greater weight than would otherwise be possible. This also reduces the strain on the projections and recesses so the furniture can be assembled and disassembled repeatedly without deformation. Alternatively, the stool or table can be formed from a thinner plastic material without any sacrifice in strength but with a decrease in cost.

The basic pedestal shown in FIG. 1 can be easily converted to a stool by adding a top cover 42 which is sized to fit over the upper base end of section 12 as shown in FIG. 1. Alternatively, a bar stool can be formed by providing the top cover with a back support 44, see FIG. 8. This is possible because the quadratic arrangement of the projections and recesses which are interlocked together permit substantial weight to be applied to the back of the bar stool without imposing a deforming torque on the interlocking projections and recesses.

Similarly, the base pedestal formed from sections 12 and 14 can be converted into a table and the height can be adjusted by using one or more spacers 46, see FIGS. 9 and 10. As seen in FIG. 10, the spacers 46 have projections and recesses at each end which are identical in shape with the recesses and projections on section 12. With this arrangement, the recesses can fit into the end of each section or can be attached to each other to lengthen the sections as desired. Additionally, any number of spacers can be attached together to vary the height of the stool or table as desired.

The table in this embodiment is provided with a rectangular top 47, see FIG. 9. This top can be constructed by securing a rectangular upper table top formed from any suitable material on the top surface of cap 42 by any suitable means.

To store the furniture when not in use, the sections 12 and 14 can be pulled apart and inserted inside each other as shown in FIG. 11. It is noted also that any number of sections can be stacked or telescoped inside each other to provide for a compact means for storing a large number of stools.

Having shown and described the invention, what I claim is new is:

1. Furniture of the class described comprising a pair of identical truncated conical sections including a circular lower base and a smaller parallel upper base formed from a thin plastic sheet material, each section having two upwardly extending, upwardly tapered projections and two downwardly extending, downwardly tapered recesses, said projections extending above the small base of the truncated conical section, said projections and recesses dividing each section into four equal parts, said projections and recesses diametrically opposite to each other and generating thereby a coaxial upwardly tapered truncated cone in each section, said truncated cone having an upper support surface concentric with the conical section in a plane parallel to the circular lower base at least closely adjacent to the plane of the small upper base of the conical section whereby in assembled relationship, the projections on one section fit into the recesses on the other section with the upper support surfaces of each upwardly tapered truncated cone facing and closely adjacent to each other when no weight is on the furniture, said upper support surfaces abutting each other when weight on the furniture causes a controlled deformation of the sections, to form a centrally disposed abutment support inside the assembled section whereby the sections can carry greater weight.

2. The furniture described in claim 1, including a cover fitting over the large end of the assembled sections to form a stool.

3. The furniture described in claim 1 including a square cover fitting over the end of a section to form a table.

4. The furniture described in claim 1 including a spacer, said spacer having projections and recesses at each end, said projections and recesses identical in shape to the projections and recesses on each section whereby the spacers can be inserted between the sections to vary the height of the furniture.

5. The furniture described in claim 2 wherein the cover has a back support so the furniture can function as a bar stool.

6. The furniture described in claim 1 wherein the sections are stackable in telescopic relationship with the projections of one section fitting into the recesses of the other.

7. The furniture described in claim 1 including a square cover fitting over the end of a section to form a table.

* * * * *